US010895261B2

(12) United States Patent
Pagnier

(10) Patent No.: US 10,895,261 B2
(45) Date of Patent: Jan. 19, 2021

(54) TURBOPUMP FOR A FLUID CIRCUIT, PARTICULARLY FOR A CLOSED CIRCUIT PARTICULARLY OF THE RANKINE CYCLE TYPE

(71) Applicants: IFP Energies nouvelles, Rueil-Malmaison (FR); ENOGIA, Marseilles (FR)

(72) Inventor: Philippe Pagnier, Saint Clair du Rhone (FR)

(73) Assignees: IFP Energies nouvelles, Rueil-Malmison (FR); ENOGIA, Marseilles (FR)

( * ) Notice: Subject to any disclaimer, the term of this patent is extended or adjusted under 35 U.S.C. 154(b) by 0 days.

(21) Appl. No.: 16/491,688

(22) PCT Filed: Feb. 12, 2018

(86) PCT No.: PCT/EP2018/053453
§ 371 (c)(1),
(2) Date: Sep. 6, 2019

(87) PCT Pub. No.: WO2018/162175
PCT Pub. Date: Sep. 13, 2018

(65) Prior Publication Data

US 2020/0072222 A1 Mar. 5, 2020

(30) Foreign Application Priority Data

Mar. 7, 2017 (FR) ..... 17 51848

(51) Int. Cl.
*F04D 13/04* (2006.01)
*F01K 25/08* (2006.01)
*F04D 29/40* (2006.01)

(52) U.S. Cl.
CPC ..... *F04D 13/043* (2013.01); *F01K 25/08* (2013.01); *F04D 29/406* (2013.01)

(58) Field of Classification Search
USPC ..... 60/614–620, 643–684
See application file for complete search history.

(56) References Cited

U.S. PATENT DOCUMENTS 2,238,502 A 4/1941 Shaw Muir et al.
4,230,564 A 10/1980 Keefer
(Continued)

FOREIGN PATENT DOCUMENTS

DE 466165 C 10/1928
FR 2822891 A1 10/2002
GB 1525342 A * 9/1978 ..... F04D 13/043

OTHER PUBLICATIONS

International Search Report for PCT/EP2018/053453, dated May 15, 2018; English translation submitted herewith (6 pgs.).

*Primary Examiner* — Shafiq Mian
*Assistant Examiner* — Mickey H France
(74) *Attorney, Agent, or Firm* — Fitch, Even, Tabin & Flannery, LLP

(57) ABSTRACT

The invention relates to a turbopump (10) comprising a stationary housing (12) comprising a pump (16) with a pump rotor (14) comprising pump vanes (28) and a turbine (20) housing a turbine rotor (18) provided with turbine vanes (44).
According to the invention, the turbopump comprises a turbine rotor (18) coaxially arranged around the rotor of the pump (16) in a plane perpendicular to said rotors.

8 Claims, 1 Drawing Sheet

(56) References Cited

U.S. PATENT DOCUMENTS

| | | | | |
|---|---|---|---|---|
| 5,876,610 | A * | 3/1999 | Clack | B01D 35/143 210/282 |
| 7,044,718 | B1 | 6/2006 | Platts | |
| 7,828,511 | B1 | 11/2010 | Pinera et al. | |
| 2012/0328446 | A1* | 12/2012 | Hunziker | F01D 5/282 416/224 |
| 2015/0152749 | A1* | 6/2015 | Nishiguchi | C09K 5/045 60/651 |

* cited by examiner

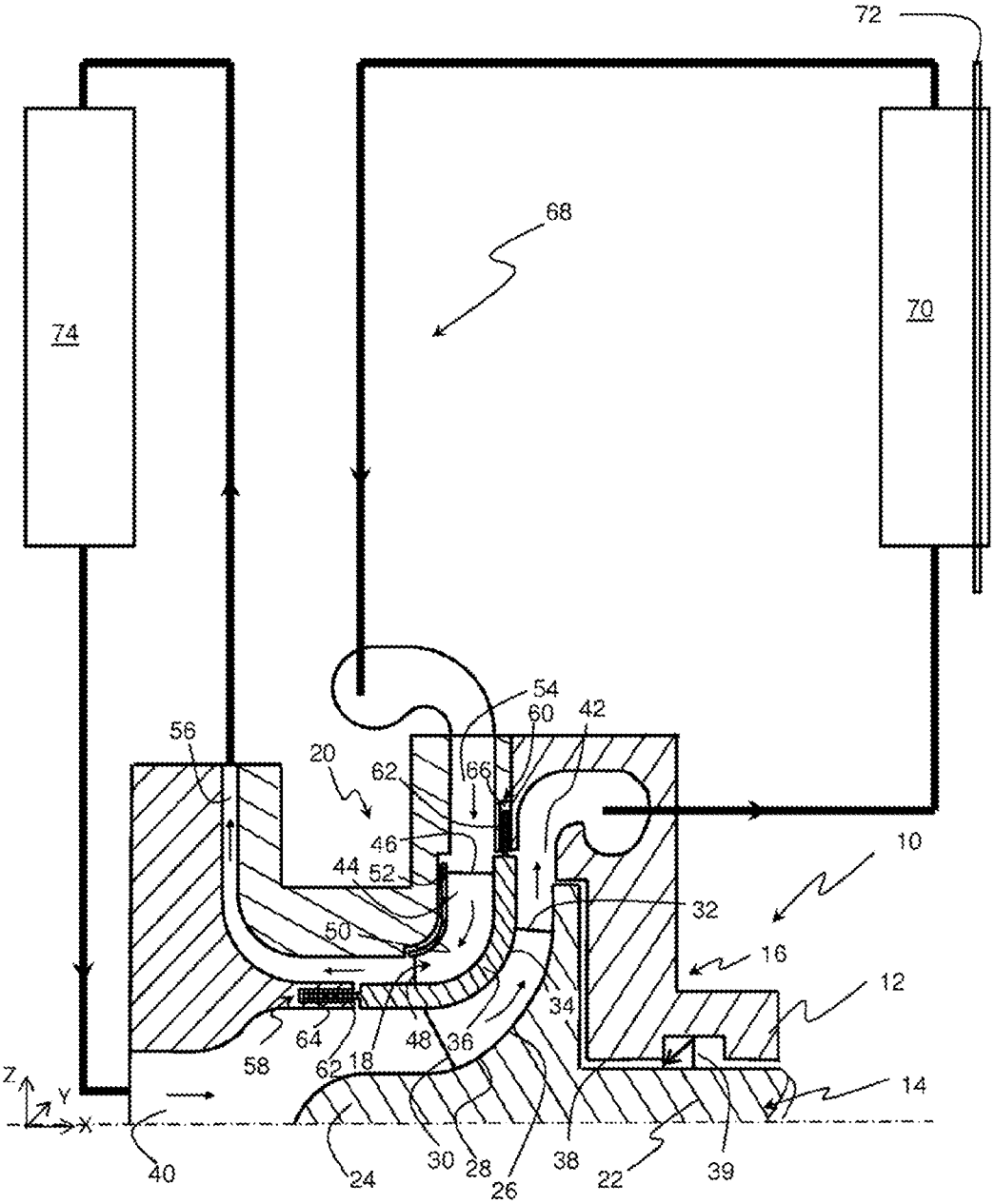
72
68
74
70
54
60
42
56
20
62
66
46
44
52
10
32
50
16
12
34
64
48
36
58
62
18
14
Z
Y
X
40
24
30
28
26
38
22
39

TURBOPUMP FOR A FLUID CIRCUIT, PARTICULARLY FOR A CLOSED CIRCUIT PARTICULARLY OF THE RANKINE CYCLE TYPE

CROSS-REFERENCE TO RELATED APPLICATIONS

This application is a U.S. national phase application filed under 35 U.S.C. § 371 of International Application No. PCT/EP2018/053453, filed Feb. 12, 2018, designating the United States, which claims priority from French Patent Application No. 17/51.848, filed Mar. 7, 2017, which are hereby incorporated herein by reference in their entirety.

The present invention relates to a turbopump used for a fluid circuit, notably for a closed circuit, particularly of the Rankine cycle type.

In general, a turbopump is a machine which comprises a turbine and a pump (or a compressor) so that some of the energy recuperated by the turbine drives the pump (or the compressor). In order to do this, the turbine and the pump (or the compressor) are mounted at the ends of a single rotation shaft.

This machine is fitted with lubricating bearings generally positioned on the central part of the rotation shaft. The turbine and the pump (or the compressor) are mounted at the ends of this rotation shaft and this requires, on the one hand, shafts that are relatively long and, on the other hand, a sealing system that allows the lubricating system to be separated from the effluents.

For the sake of simplicity in the remainder of the description the term "turbopump" will be used for a machine which could just as well comprise a turbine and a pump as a turbine and a compressor, and the term "pump" will also cover a pump just as well as it does a compressor.

As is better described in U.S. Pat. No. 7,044,718, reducing the length of the shaft and, therefore, the axial size of the turbopump, is already known.

In this document, the turbine and the pump are imbricated one inside the other so that the ducts of the turbine and those of the pump are also imbricated in one another about the rotation shaft, something which allows the axial length of the machine to be reduced appreciably.

The present invention proposes to reduce the length of the rotation shaft, and therefore the size of the turbopump, still further.

It also makes it possible to reduce the number of bearings and simplify the lubricating circuits.

To this end, the present invention relates to a turbopump comprising a fixed housing comprising a pump with a pump rotor comprising pump vanes and a turbine housing a turbine rotor bearing turbine vanes, characterized in that the turbopump comprises a turbine rotor positioned coaxially around the rotor of the pump in the one same plane perpendicular to the axis of said rotors.

The pump rotor may comprise radial vanes bearing a circumferential shroud at their tips.

The circumferential shroud may bear radial turbine rotor vanes arranged coaxially with and above the vanes of the pump rotor.

The radial tips of the turbine rotor vanes may bear a closed circumferential band substantially coaxial with the shroud.

The shroud may comprise means of sealing with the fixed housing.

The sealing means may comprise a set of labyrinth seals at each end of the shroud.

The other features and advantages of the invention will become apparent from reading the following description, given solely by way of nonlimiting illustration, and to which is appended the single FIGURE which shows the turbopump according to the invention and its associated circuit.

In this FIGURE, the turbopump has the feature of comprising a turbine which is positioned at the periphery of the pump. The turbine and the pump, and therefore the turbine and pump rotors, are thus both coplanar, because they are positioned in a plane perpendicular to the rotation shaft of the machine, and coaxial, because they both rotate about the same rotation axis. Specifically, the axis X of the orthonormal frame of reference (X, Y, Z) in the FIGURE is at once the axis of the turbine rotor and the axis of the pump rotor. The turbine and pump rotors are in the same plane, parallel to the plane YZ of the orthonormal frame of reference (X, Y, Z), the plane YZ of the frame of reference being orthogonal to the axis X.

The turbopump 10 comprises a fixed housing 12 which houses the rotating part 14 of a pump 16 (or pump rotor) and the rotating part 18 of a turbine 20 (or turbine rotor).

The pump rotor comprises a cylindrical shaft 22 connected at one end to a hub 24 of substantially frustoconical (truncated conical) shape having a concave circumferential wall 26. This wall bears a multitude of vanes 28 projecting radially from the wall and evenly spaced around the external periphery of this wall. The vanes comprise a leading edge 30 some distance from the free end of the hub 24, a trailing edge 32 some distance from the base of the frustoconical (truncated conical) hub 24, and a radial exterior tip 34 with a curvature substantially equal to that of the concave wall 26.

As can best be seen in the FIGURE, a curved circumferential shroud 36 is fitted, advantageously by shrink-fitting, over the radial tips 34 of the vanes notably in order to reduce flow losses.

This pump rotor is placed in the fixed housing 12 which comprises an axial bearing 38 to accept the shaft 22 of the pump rotor, a sealing system 39 associated with the bearing 38, an axial inlet 40 for a fluid facing the hub 24 and which is coaxial with the bearing, being positioned upstream of the vanes, and a radial fluid outlet 42 which is in communication with the downstream part of these vanes.

This outlet 42 is advantageously volute shaped so as to guide the fluid toward the equipment it is to supply.

The pump thus comprises the shaft 22, the hub 24 with the concave wall 26, the vanes 28, the shroud 36 and a portion of the fixed housing with the bearing 38, the fluid inlet 40 and the fluid outlet 42.

The shroud 36, on the opposite face to the shroud that bears the vanes 28 of the pump, bears a multitude of vanes 44 projecting radially and uniformly spaced on the exterior periphery of this shroud. These vanes constitute the vanes of the turbine and are coaxial with, and substantially in the same radial plane as, the vanes of the pump. The vanes of the turbine comprise a leading edge 46, a trailing edge 48, and a radial exterior tip 50 with a curvature substantially identical to that of the shroud.

In a similar way to the shroud of the vanes of the pump, a curved circumferential closed band 52 may be positioned, advantageously by shrink-fitting, over the radial exterior tips 50 of the turbine vanes 44, being coaxial with the shroud of the vanes of the pump.

The turbine rotor is thus formed by the shroud 36, the turbine vanes 44 and possibly the band 52 of the turbine vanes, being mounted on the peripheral part of the rotor of the pump and thus forming an integral part of this pump rotor.

This turbine rotor is positioned inside the fixed housing 12 which comprises a fluid inlet 54, advantageously in the shape of a volute, facing the leading edge 46, turbine vanes 44 and a fluid outlet 56 facing the trailing edge 48 of these turbine vanes.

This configuration allows the compressor to be driven directly by the turbine via the vanes of the turbine and the shroud.

The force exerted by the fluid on the vanes of the turbine, combined with a large radius around the rotor of the pump, contributes to providing a greater deal of work than would be necessary to drive the compressor.

According to one embodiment, the turbine can operate without an electrical power supply, notably without an electric motor. It is therefore driven solely by the fluid.

Likewise, for this embodiment, it is possible for the pump not to be driven by an electrical power supply. It therefore requires no electric motor and is driven solely by the turbine.

Thus, residual work is available on the shaft of the machine to drive any mechanical or electrical device, such as an alternator/generator for example. Thus, the system uses no electrical power supply to operate it but rather allows a quantity of energy to be recuperated in the form of electric energy.

It is also necessary to ensure sealing between the shroud and the housing and this is done using sealing means positioned on the free ends of this shroud which separates the turbine from the pump.

To do this, these sealing means may be a set of labyrinth seals 58, 60 with, as illustrated by way of example in the FIGURE, a leaf 62 formed at each end of the shroud and penetrating grooves 64, 66. One 66 of the grooves is positioned between the inlet 54 of the turbine and the outlet 42 of the pump, and the other 64 of the grooves is situated between the inlet 40 of the pump and the outlet 56 of the turbine.

Sealing is improved by ensuring, on the one hand, equal pressures between the outlet of the pump 42 and the inlet of the turbine 54 (on the high-pressure side) and, on the other hand, equal pressures between the inlet of the pump 40 and the outlet of the turbine 56 (on the low-pressure side).

The turbopump as described hereinabove may be used in numerous fields, such as the petroleum, aeronautical, automotive, etc. fields.

This turbopump is more particularly suited to applications involving a closed circuit, particularly a circuit 68 of the Rankine cycle type, as illustrated in the single FIGURE.

This closed Rankine cycle circuit is advantageously of the ORC (Organic Rankine Cycle) type and uses an organic working fluid or mixtures of organic fluids such as butane, ethanol, hydrofluorocarbons.

Of course the closed circuit may also operate with a fluid such as ammonia, water, carbon dioxide, etc.

Thus, the outlet 42 of the pump is connected to a heat exchanger 70, termed evaporator, through which the working fluid compressed by the pump passes and by virtue of which the working fluid re-emerges from this evaporator in the form of a compressed vapor.

This evaporator also has passing through it a hot source 72 in liquid or gaseous form, so that it can release its heat to the working fluid. This hot source makes it possible to vaporize the fluid, and may come from varying hot sources, such as a coolant from a combustion engine, from an industrial process, from a furnace, hot gases resulting from combustion (flue gases of an industrial process, from a boiler, exhaust gases from a turbine, etc.), from a flow of heat derived from thermal solar collectors, etc.

The outlet of the evaporator is connected to the inlet 54 of the turbine 20 so as to admit the working fluid thereinto in the form of a high-pressure compressed vapor, this fluid re-emerging via the outlet 56 of this turbine in the form of low-pressure expanded vapor.

The outlet 56 of the turbine is connected to a cooling exchanger 74, or condenser, which allows the expanded low-pressure vapor that it receives to be converted into a low-pressure liquid fluid. This condenser is swept by a cold source, generally a flow of ambient air or of cooling water, so as to cool the expanded vapor so that it condenses and is converted into a liquid.

Of course, the various elements of the circuit are connected together by fluid circulation pipes that allow them to be connected in succession.

The invention claimed is:

1. A turbopump comprising a fixed housing containing a pump with a pump rotor comprising radial pump vanes bearing a circumferential shroud at their radial tips, the circumferential shroud being fitted by shrink-fitting over the radial tips of the radial vanes, and a turbine housing a turbine rotor bearing turbine vanes, wherein the turbine rotor is positioned coaxially around the pump rotor in the same plane perpendicular to the axis of the pump rotor and the turbine rotor.

2. The turbopump as claimed in claim 1, wherein the circumferential shroud bears radial turbine rotor vanes arranged coaxially with and above the vanes of the pump rotor.

3. The turbopump as claimed in claim 1, wherein the radial tips of the turbine rotor vanes bear a closed circumferential band substantially coaxial with the shroud.

4. The turbopump as claimed in claim 1, wherein the shroud comprises sealing means or sealing the shroud with the fixed housing.

5. The turbopump as claimed in claim 4, wherein the sealing means comprise a set of labyrinth seals positioned at each end of the shroud.

6. An application of a turbopump as claimed in claim 1 to a closed circuit of the Rankine or ORC (Organic Rankine Cycle) type.

7. A closed circuit of the Rankine or ORC (Organic Rankine Cycle) type comprising the turbopump as claimed in claim 1.

8. The closed circuit of the Rankine or ORC (Organic Rankine Cycle) type as claimed in claim 7, further comprising:

an evaporator having an inlet configured to receive working fluid compressed by the pump, a pass-through for a hot source in liquid or gaseous form passing through the evaporator, and an outlet configured to allow the working fluid exit in the form of a compressed vapor; and a condenser having an inlet configured to receive expanded low-pressure vapor from an outlet of the turbine, the condenser being configured to be swept by a cold source, and an outlet configured to allow a low-pressure liquid fluid to exit, wherein the outlet of the evaporator is connected to the inlet of the turbine, the outlet of the turbine is connected to the inlet of the condenser, the outlet of the condenser is connected to an inlet of the pump, and an outlet of the pump is connected to the inlet of the inlet of the evaporator.

* * * * *